US006805206B2

(12) United States Patent
Hanke

(10) Patent No.: US 6,805,206 B2
(45) Date of Patent: Oct. 19, 2004

(54) HAMMER

(75) Inventor: Andreas Hanke, Idstein (DE)

(73) Assignee: Black & Decker, Inc., Newark, DE (US)

( * ) Notice: Subject to any disclaimer, the term of this patent is extended or adjusted under 35 U.S.C. 154(b) by 0 days.

(21) Appl. No.: 10/304,645

(22) Filed: Nov. 26, 2002

(65) Prior Publication Data

US 2003/0075347 A1 Apr. 24, 2003

Related U.S. Application Data

(63) Continuation of application No. 09/804,205, filed on Mar. 12, 2001, now Pat. No. 6,513,604.

(30) Foreign Application Priority Data

Mar. 10, 2000 (GB) ..... 0005818
Jun. 2, 2000 (GB) ..... 0013298

(51) Int. Cl.[7] ..... E02D 7/02

(52) U.S. Cl. ..... 173/48; 173/104; 173/109; 173/90; 279/902; 408/139

(58) Field of Search ..... 173/48, 47, 104, 173/109, 114, 216, 90, 178, 176; 279/150, 140, 902; 408/139; D8/61–70

(56) References Cited

U.S. PATENT DOCUMENTS 2,121,706 A * 6/1938 Little ..... 173/122
2,638,749 A * 5/1953 Sparano ..... 60/542
3,570,608 A * 3/1971 Erma ..... 173/201
3,872,951 A * 3/1975 Hastings, Jr. ..... 188/69
4,094,365 A * 6/1978 Wanner ..... 173/117
4,384,224 A * 5/1983 Spitler et al. ..... 310/81
4,691,929 A 9/1987 Neumaier et al.
5,199,833 A * 4/1993 Fehrle et al. ..... 279/19.3
5,209,308 A * 5/1993 Sasaki ..... 173/178
5,496,139 A * 3/1996 Ghode et al. ..... 188/69
5,839,517 A * 11/1998 Gwinn et al. ..... 173/162.2
5,927,407 A 7/1999 Gwinn et al.
5,947,254 A * 9/1999 Jones ..... 192/223.2
5,971,403 A 10/1999 Yahagi et al.
6,073,705 A 6/2000 Shibata et al.
6,092,814 A * 7/2000 Kageler ..... 279/14
D447,677 S * 9/2001 Stirm ..... D8/69

FOREIGN PATENT DOCUMENTS

DE 3336711 4/1985
DE 19600339 12/1996
GB 2297513 8/1996

* cited by examiner

*Primary Examiner*—Stephen F. Gerrity
*Assistant Examiner*—Thanh Truong
(74) *Attorney, Agent, or Firm*—Michael P. Leary; Bruce S. Shapiro; Charles E. Yocum

(57) ABSTRACT

A hammer is provided which enables the orientation of a tool or bit mounted within a spindle of the hammer to be rotated to the required orientation. The hammer comprises a housing part having an aperture therein in which a spindle that is mounted so that the spindle extends out of the housing through the aperture. The spindle is capable of being rotated about its axis to any of a plurality of orientations, so as to alter the orientation of a tool or bit mounted therein. A locking ring is located around the spindle which locking ring can be moved axially along the spindle into and out of engagement with the housing part, so that when the locking ring engages the housing, it prevents the spindle from rotating with respect to the housing. A grip ring is located around the spindle and can be rotated about the axis of the spindle from a first position in which it prevents disengagement of the locking ring from the housing. When the grip ring is rotated about the axis of the spindle to a second position, the locking ring is disengaged from the housing, thereby to allow the spindle to rotate with respect to the housing to a different orientation.

2 Claims, 11 Drawing Sheets

HAMMER

CROSS-REFERENCE TO RELATED APPLICATIONS

This application is a continuation of U.S. Ser. No. 09/804,205, filed on Mar. 12, 2001, now U.S. Pat. No. 6,513,604.

BACKGROUND OF THE INVENTION

This invention relates to electric hammers, and in particular to demolition hammers.

Such hammers will normally contain a housing and a spindle that extends through an aperture in the housing at the front end of the hammer. The hammer is normally provided with an impact mechanism comprising a motor that drives a reciprocating piston in the spindle, which in turn drives a ram and a beat piece in the spindle by means of an air cushion mechanism. Such mechanisms are well known and will not be described further. The spindle allows insertion of the shank of a bit, for example a drill bit or a chisel bit, into the front end thereof so that it is retained in the front end of the spindle with a degree of axial movement, and is, in operation of the hammer, repeatedly struck by the beat piece.

It is possible for some hammers to be employed in combination impact and drilling mode in which the spindle, and hence the bit inserted therein, will be caused to rotate at the same time as the bit is struck by the beat piece, but most hammers will be able to be employed in pure impact mode or so-called "chipping" mode (whether or not they can also be employed in other modes) in which the bit is struck by the beat piece without rotation of the spindle. In this mode, the hammer will usually be employed with a flat chisel bit rather than with a generally cylindrical drill bit, and it will often be desired by the operator of the hammer to change the orientation of the chisel bit in the hammer to adjust to different positions and/or orientations of the surface that is being worked on. Thus a number of arrangements have been proposed for enabling the bit to be rotated with respect to the hammer during use. It will be appreciated that the orientation of the spindle itself needs to be changed when the orientation of the bit is changed since the bit will usually be capable of being coupled in the spindle at one or two orientations only.

A number of designs of hammer have been proposed in which the orientation of the bit in the spindle may be changed. However, such designs have normally suffered from the disadvantage that the hammer includes a spindle locking mechanism that is actuated by moving a part axially along the spindle, before the spindle is rotated to its desired position. The operation of changing the orientation of the bit thus becomes rather awkward, requiring the operator to move the tool holder in one direction and then maintain the tool holder in that position while rotating it. Furthermore, the spindle locking mechanism will usually require a relatively strong bias against movement in the axial direction since it is in the axial direction of the spindle that the hammer is subject to impacts during normal operation, and the mechanism must withstand such impacts. Thus, it would be desirable for a hammer to employ a spindle locking mechanism that can be actuated by rotation only.

SUMMARY OF THE INVENTION

According to one aspect, the invention provides a hammer which comprises:

a housing having an aperture therein;

a spindle that is located in the housing, and extends out of the housing through the aperture, the spindle being capable of being rotated about its axis to any of a plurality of orientations; and a locking ring that is located around the spindle and which can be moved axially along the spindle at least to a limited extent into and out of engagement with the aperture of the housing, but cannot rotate about the spindle, so that when the locking ring engages the aperture, it prevents the spindle from rotating with respect to the housing; and the hammer additionally comprises a grip ring that is located around the spindle and can be rotated by the operator of the hammer about the axis of the spindle from a normal operating position in which it prevents disengagement of the locking ring from the aperture in the housing to a second position in which the locking ring is disengaged from the aperture of the housing, thereby to allow the spindle to rotate with respect to the housing to a different orientation.

Thus, it is possible to form a hammer in which the orientation of the bit can be changed in a particularly simple manner: the operator simply rotates the grip ring to a position in which the spindle lock is released, or at least can be released, and then rotates the grip ring further, which may, if desired, be against a slightly higher resistance to rotation, until the bit is in the correct orientation. Preferably the grip ring is biased to the normal operating position at which disengagement of the locking ring from the aperture is prevented. In a preferred embodiment the grip ring will move under its bias to the normal operating position when it is released by the operator, so that no further operation is necessary once the bit is in the correct position. In a preferred embodiment, rotation of the grip ring to the second position causes part of the grip ring to bear on the locking ring in the circumferential direction so that further rotation of the grip ring beyond the second position will cause it to rotate the locking ring and thereby the spindle.

As stated above, the locking ring cannot rotate about the spindle (and thus is able to lock the spindle in its orientation in the aperture). It is capable of being rotated about the axis of the spindle, and will be rotated in this manner when the orientation of the tool bit is changed, but when it is rotated about the axis of the spindle it will cause the spindle itself to be rotated. This may be achieved by a number of means, essentially by ensuring that the mating parts of the spindle and locking ring do not have circular cross-sections. For example, the spindle may be provided with flats on its periphery, or it may have a polygonal, e.g. hexagonal, cross-section, or it may have a number of axially extending splines, and, whatever form of spindle, the bore of the locking ring will have a complementary shape. Like the locking ring, the grip ring can also be rotated about the axis of the spindle. However, in some forms of the hammer, the grip ring can be rotated about the spindle, at least to a limited extent, that is to say, it can be rotated about the axis of the spindle at least to a limited extent without the spindle itself rotating. In one form of hammer, rotation of the grip ring to the second position causes a part of the grip ring to bear on the locking ring in the circumferential direction so that further rotation of the grip ring beyond the second position will cause it to rotate the locking ring and thereby the spindle, since the locking ring cannot rotate about the spindle. This may be achieved if one of the locking ring and the grip ring has at least one protuberance that extends in the axial direction into an aperture or recess in the other of the locking ring and the grip ring. In this case, the aperture or recess may extend in the circumferential direction to a greater extent than the protuberance to allow the grip ring to be rotated to the second position without rotation of the locking ring, but to allow rotation of the grip ring beyond the second position only with rotation of the locking ring.

The locking ring and the grip ring may be so configured that at least part of the grip ring will abut the locking ring in the axial direction and maintain it in engagement with the aperture in the normal operating position, but when the grip ring has been rotated to a certain extent, the abutting parts move away from one another to allow axial movement of the locking ring, either freely or against a bias applied to the locking ring. This may be achieved, for example by means of one or more axial protuberances on one of the locking ring and the grip ring that bear on part of the other of the locking ring and the grip ring, but which will move circumferentially out of the way when the grip ring is rotated. In this way, the grip ring may be rotated about the spindle from the normal operating position in which it holds the locking ring in engagement with the housing aperture and thereby locks the spindle in one position with respect to the hammer, to the second position (without so far any rotation of the locking ring) in which the locking ring is still in engagement with the aperture, but is not held in engagement with the aperture by the grip ring. Further rotation of the grip ring about the spindle will cause the locking ring, and hence the spindle, to rotate. In order to do this, the locking ring must move out of engagement with the aperture. This may be achieved by providing at least one of the locking ring and the housing with at least one surface that is bevelled (in the circumferential direction in relation to the axis of the spindle) and bears on part of the other of the locking ring and the housing so that the bevelled surface forces the locking ring out of engagement with the aperture when it is rotated about the axis of the spindle by the grip ring. Preferably the locking ring and the aperture each have bevelled surfaces that bear on one another to force the locking ring out of engagement with the aperture. Such bevelled surfaces may, for example, be formed on teeth that are provided on the locking ring and on the housing aperture and which engage one another in the normal operating position.

In another form of hammer, the locking ring may be urged into engagement with the aperture by some means other than the grip ring, such as a spring, and a screw mechanism is provided so that rotation of the grip ring will move the locking ring axially along the spindle out of engagement with the aperture. In this form of hammer, the grip ring and the locking ring may be provided with at least one surface that bears on a corresponding surface of the other of the grip ring and the locking ring and which is bevelled in the circumferential direction in relation to the axis of the spindle, i.e. has a helically extending portion, so that the surface forces the locking ring out of engagement with the aperture when the grip ring is rotated to the second position.

The grip ring may be biased into its normal operating position by any of a number of means. For example, one or more springs may be provided that extend in the circumferential direction between parts of her grip ring and the locking ring. Alternatively, a bias ring may be provided that is located around the spindle and is biased axially toward the grip ring, at least one of the grip ring and the bias ring having at least one surface that bears on the other of the grip ring and the bias ring in the axial direction and slopes in such a direction that the grip ring is biased to its normal operating position.

Often, the grip ring will be arranged so that it will not be able to move axially along the spindle, and this requirement may be necessary when the grip ring prevents, in normal use, the locking ring from sliding axially along the spindle in a forward direction. However, this is not essential, and in some forms of hammer, limited axial movement of the grip ring along the spindle may be allowed (although this is not normally advantageous). For example, it is normally necessary to provide some means for limiting axial movement of the grip ring along the spindle toward the aperture, in order to enable the grip ring to move the locking ring along the spindle out of engagement with the aperture. However, if some means other than the grip ring is used to keep the locking ring in engagement with the aperture in normal use, it is possible to allow some forward movement of the grip ring.

While the spindle locking mechanism will often be provided as an integral part of a hammer, and especially of a hammer that is designed to be employed only in chipping mode, it is possible for the mechanism to form part of a tool holder that can be removed from the remainder of the hammer. Thus, according to another aspect, the invention provides a tool holder for attachment to a hammer which comprises:

a housing part having an aperture therein;

a spindle that is located in the housing part, and extends out of the housing part through the aperture, the spindle being capable of being rotated about its axis to any of a plurality of orientations;

a locking ring that is located around the spindle and which can be moved axially along the spindle at least to a limited extend into and out of engagement with the aperture of the housing part, but cannot rotate about the spindle, so that when the locking ring engages the aperture, it prevents the spindle from rotating with respect to the housing part; and the hammer additionally comprises a grip ring that is located around the spindle and can be rotated by the operator of the hammer about the axis of the spindle from a normal operating position in which it prevents disengagement of the locking ring from the aperture in the housing part to a second position in which the locking ring is disengaged from the aperture of the housing part, thereby to allow the spindle to rotate with respect to the housing to a different orientation.

BRIEF DESCRIPTION OF THE DRAWINGS

The tool holder spindle will normally be connected to the spindle of the hammer by means of a conventional locking element arrangement which prevents any axial or rotational movement between the two spindles.

Four forms of hammer according to the invention will now be described by way of example, with reference to the accompanying drawings in which.

DESCRIPTION OF PREFERRED EMBODIMENT

Figure 1:
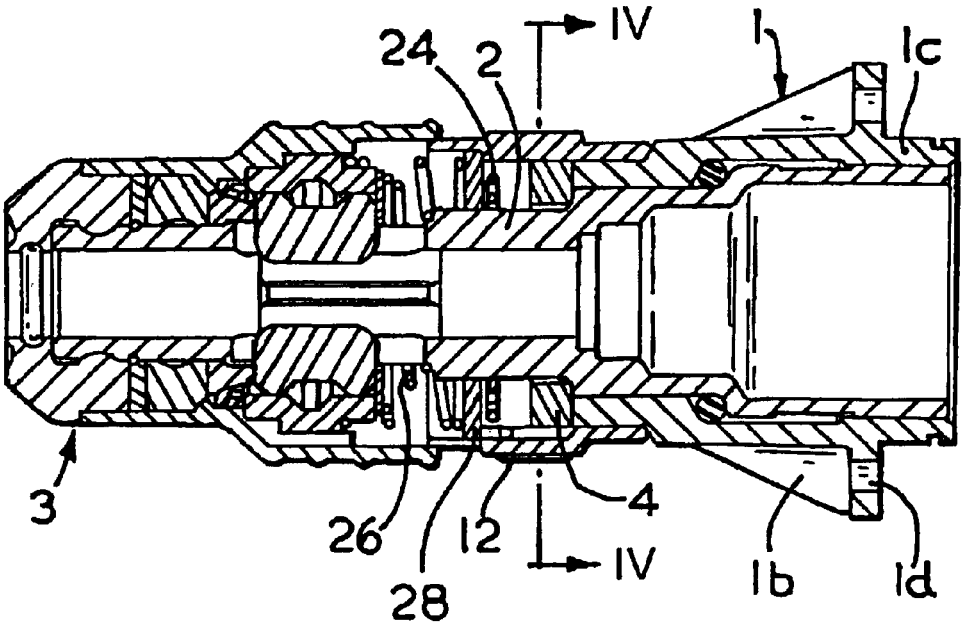
FIG. 1 is a side sectional elevation of a tool holder region of a hammer according to the present invention.
Figure 2:
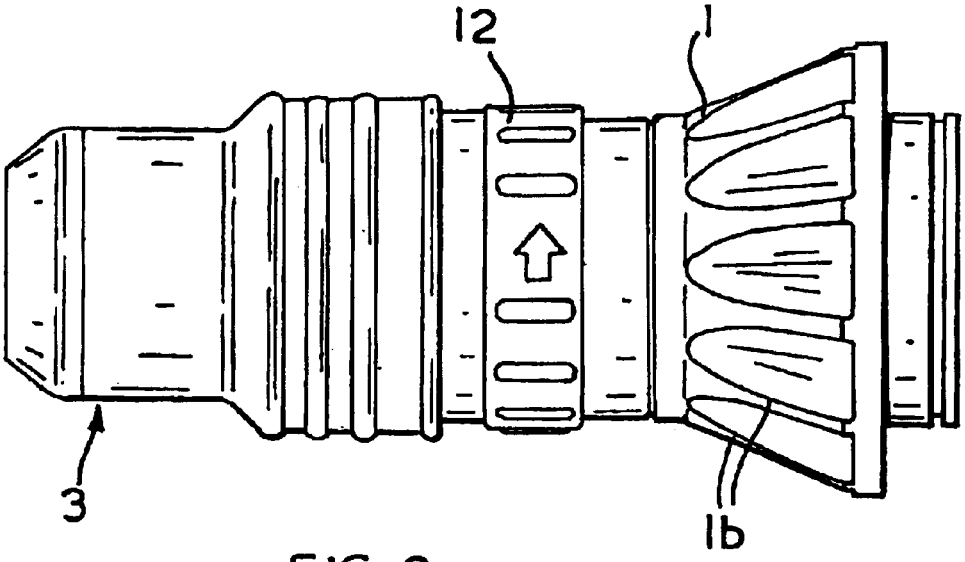
FIG. 2 is a side elevation of the tool holder of FIG. 1.

Referring to FIGS. 1 to 7 of the accompanying drawings, a demolition hammer has a housing 1 in which a spindle 2 is located so that it extends through and beyond an aperture formed in the housing, and is provided at its end with a tool holder 3 of conventional form for holding the shank of a tool (not shown) of the type that can move to a limited extent upon impacts from a beat piece (which may be SDS Plus or SDS Max, but will usually be larger, for example hex shank etc.). The spindle 2 is freely rotatable within the housing 1 and has a hexagonal outer cross-section towards its front end. The mechanism includes a locking ring 4 that is located about the spindle just beyond the aperture in the housing 1, and which locks the spindle in one orientation in the aperture. The locking ring has a hexagonal internal aperture 6 through which the spindle 2 extends with a slidable fit to enable the locking ring to move axially along the spindle 2 but not to rotate about it. The locking ring 4 has a number of teeth 8 at its rearward end (i.e. directed away from the tool holder) which engage corresponding teeth 10 in the housing 1 around the aperture so that they are interdigitated with one another. In this manner, rotation of the locking ring 4, and hence the spindle 2 with respect to the housing 1 is prevented while the teeth 8 and 10 are engaged.

A grip ring 12 is located around the spindle 2 and the locking ring 4 and has an internal diameter approximately equal to the external diameter of the locking ring, so that it can be manually rotated around the locking ring 4 by the operator. The grip ring 12, however, has a central portion 14 having a relatively large wall thickness, and a thinner front-end portion 16, the region joining the two portions forming an internal shoulder 18 that extends around the circumference of the grip ring. Over part of the circumference of the grip ring 12, in fact along three separate regions that are oriented at 120° to one another, the internal shoulder 18 is bevelled in the circumferential direction in relation to the axis of the spindle 2 and the grip ring 12, that is to say, in those regions, the internal shoulder 20 extends helically along the internal circumference of the grip ring 12. The locking ring 4 is provided with three lugs 22 located on its peripheral surface that are oriented at 120° to one another and each engages one of the bevelled or helically extending internal shoulder regions 20 of the grip ring 12, so that, when the grip ring 12 is rotated (in the direction of the arrow on its peripheral surface), the locking ring 4 will be forced axially along the spindle 2 out of engagement with the teeth 10 of the housing.

The arrangement is provided with a coil spring 24 that extends around the spindle 2, one end of which is located in a recess in the spindle, and the other end of which is located in a recess in the internal surface of the grip ring 12. This spring 24 biases the grip ring 12 to rotate to its original orientation with respect to the locking ring when not held by the operator. A further helical spring 26 is provided which bears on an axial biasing member 28 to urge it rearwardly toward the housing 1. The biasing member 28 has three legs 30, each of which buts onto the forward end of one of the lugs 22 of the locking ring 4 in order to urge the locking ring 4 into engagement with the aperture in the housing 1.

In operation, a tool bit (not shown) such as a chisel bit may be inserted into the tool holder in any desired orientation. If it is desired to change the orientation of the bit, the operator simply grips the grip ring 12 and rotates it until the desired orientation is reached and lets go of the ring. As the grip ring 12 is rotated, the lugs 22 on the locking ring 4 ride up the helical surface 20 of the internal shoulder 18 of the grip ring, thereby forcing the teeth 8 and 10 out of engagement with each other against the force of the axial bias member 28. Further rotation of the grip ring 12 causes the spindle 2 to rotate, and enables the bit inserted in the tool holder 3 to be set at the desired orientation. Release of the grip ring 12 by the operator will cause it to rotate in the opposite direction under the action of the spring 24, and allow the locking ring 4 to slide axially under the action of the bias member 28 into engagement with the teeth 10 of the housing 1.

Figure 3A:
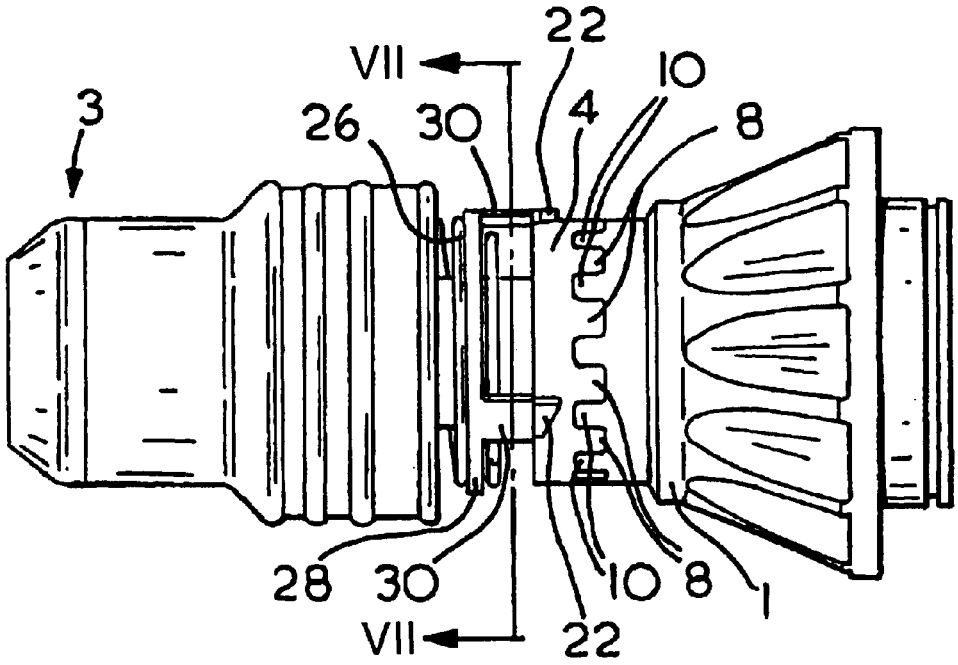
FIG. 3*a* is a side elevation of the tool holder of FIGS. 1 and 2 with the grip ring removed.
Figure 3B:
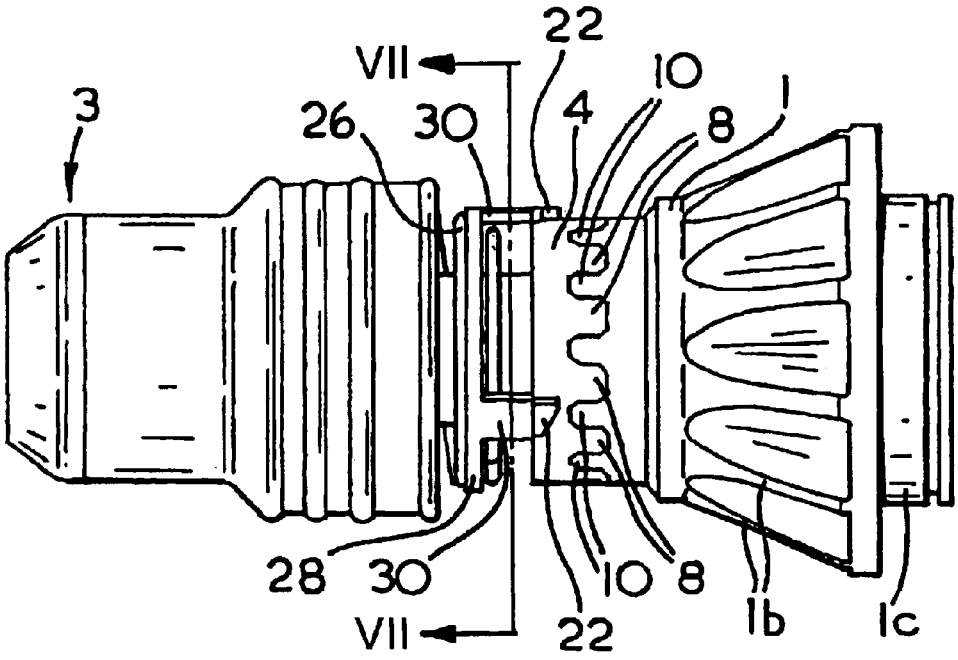
FIG. 3*b* is a side elevation of an alternative arrangement of the tool holder of FIGS. 1 and 2 with the grip ring removed.
Figure 3C:
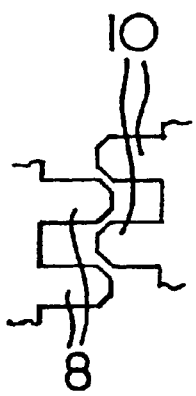
FIGS. 3*c* to 3*f* illustrate different relative positions of the sets of teeth of the arrangement of FIG. 3*b* as the grip ring is rotated.
Figure 3D:
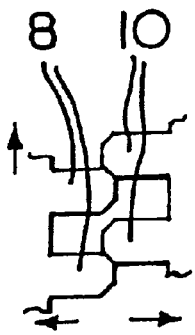
Figure 3E:
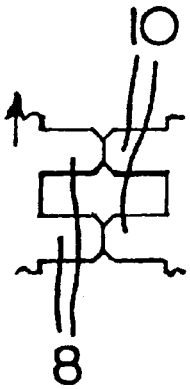
Figure 3F:
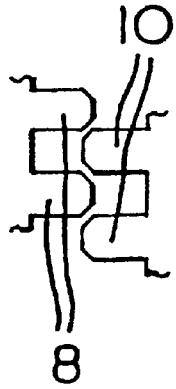
Figure 4:
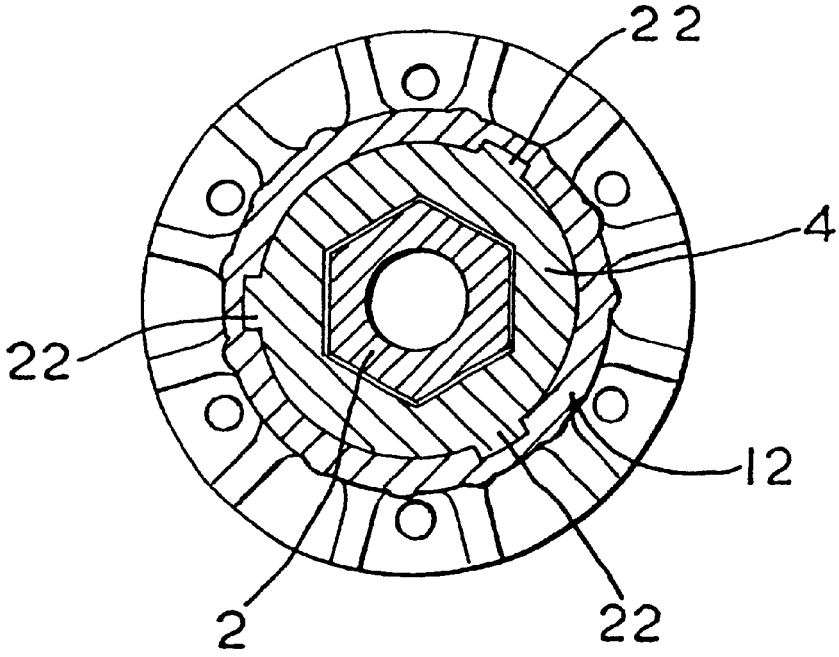
FIG. 4 is a sectional elevation of the tool holder taken along the line IV—IV of FIG. 1.
Figure 5:
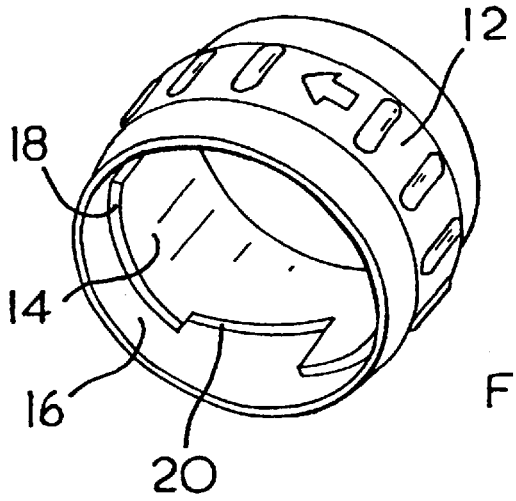
FIG. 5 is a perspective view of the grip ring of the tool holder of FIG. 1.
Figure 6:
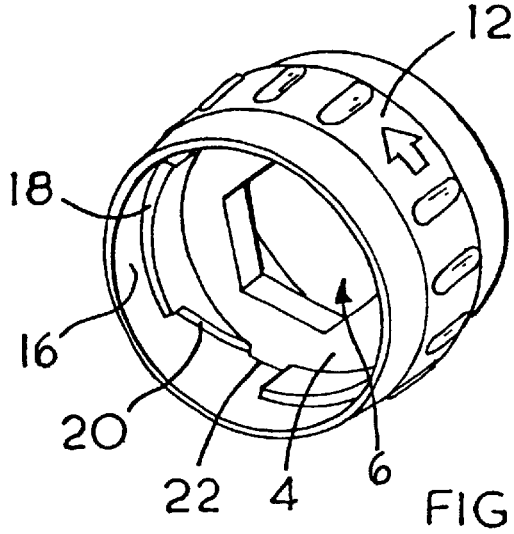
FIG. 6 is a perspective view of the grip ring shown in FIG. 1 together with part of the locking ring of the tool holder.
Figure 7:
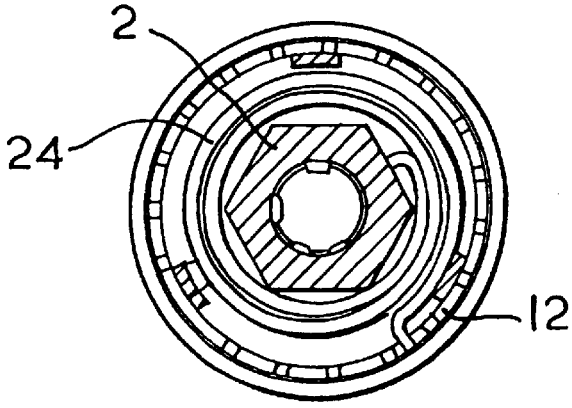
FIG. 7 is a section through the tool holder of FIGS. 1 to 6 along the line VII—VII of FIG. 3.
Figure 8:
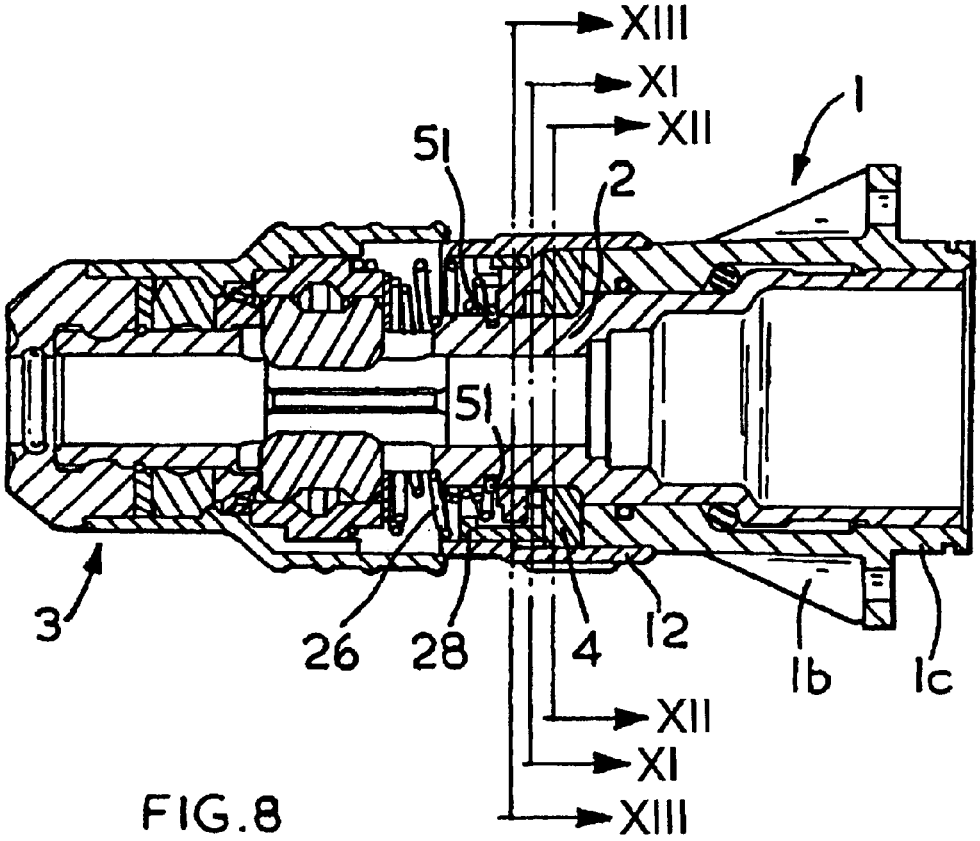
FIG. 8 is a side sectional elevation of the tool holder region of a second form of hammer according to the present invention.
Figure 9:
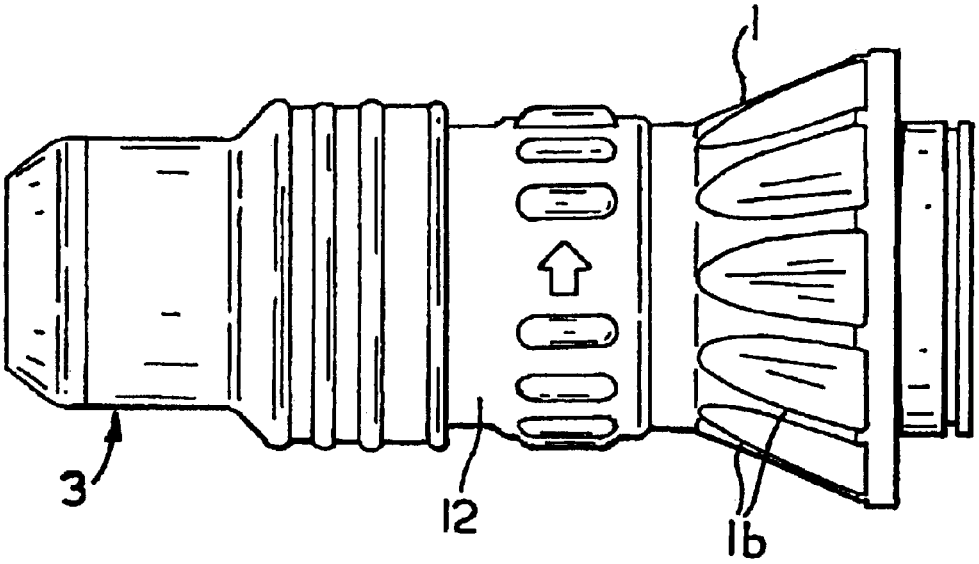
FIG. 9 is a side elevation of the tool holder of FIG. 8.
Figure 10:
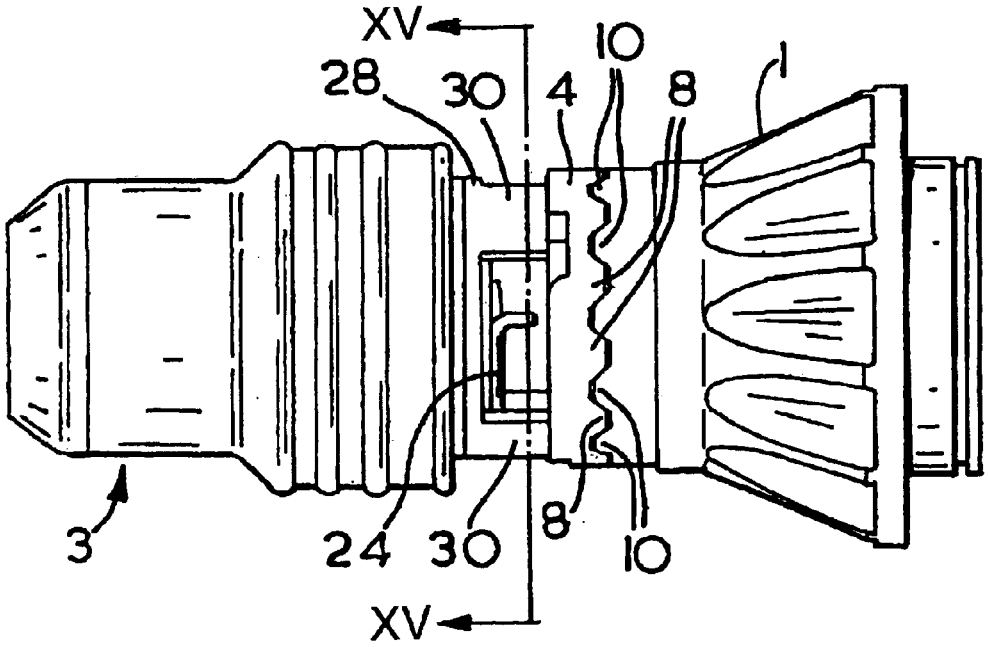
FIG. 10 is a side elevation of the tool holder of FIG. 8 with the grip ring removed.

FIG. 3*b* shows an arrangement similar to that shown in FIG. 3*a*, with like parts identified by like numerals, except that the sets of teeth 8 and 10 are formed with ends that have chamfered edges. In this arrangement, as the grip ring 12 is rotated, the lugs 22 on the locking ring 4 ride up the helical surface 20 of the internal shoulder 18 of the grip ring, thereby forcing the teeth 8 and 10 partially out of engagement with each other against the force of the axial bias member 28 so that the chamfered edges of the ends of the sets of teeth 8 and 10 are adjacent each other, as shown in FIG. 3*c*. Further rotation of the grip ring 12 causes the chamfered edges of the ends of adjacent teeth to ride over each other, as shown in FIGS. 3*d* and 3*e* against the axial biasing force of the bias member 28 so that the locking ring rotates with respect to the aperture. The rotation of the locking ring 4 causes the spindle 2 to rotate, and so enables the bit inserted in the tool holder 3 to be set at the desired orientation. As the ends of the sets of teeth 8 and 10 ride over each other the sets of teeth 8 and 10 are successively pushed apart to the position shown in FIG. 3*e* and moved together to the position shown in FIGS. 3*c* and 3*f*. As the sets of teeth are urged back towards each other by the axial bias member 28 after successive teeth ends have passed over each other, a ratchet like clicking noise is made which gives an indication to an operator of the hammer that successive gradations of rotation of the spindle have occurred. Release of the grip ring 12 by the operator will cause it to rotate in the opposite direction under the action of the spring 24, and allow the locking ring 4 to slide axially under the action of the bias member 28 into engagement with the housing teeth 10.

Another form of arrangement is shown in FIGS. 8 to 15. In this form of hammer, a spindle 2 having a hexagonal forward cross-section extends through an aperture in the hammer housing 1 and is freely rotatable within the housing. A locking ring 4 is located about the spindle 2, and holds the spindle in one orientation by virtue of an array of teeth 8 that engage corresponding teeth 10 in the housing 1 around the aperture. However, in this form of hammer, the teeth 8 and 10 have bevelled edges.

A grip ring 12 extends around the spindle 2 and the locking ring 4, but instead of having a hexagonal aperture therein for the spindle, the grip ring has an aperture 46 of complex shape, described most easily as being generally of the form of a hexagon but having a small part circular or part hexagonal recess 50 at each vertex of the hexagon. The generally hexagonal form of the aperture 46 fits the cross-section of the spindle 2, but each part circular or part hexagonal recess 50 allows the grip ring 12 to be manually rotated by approximately 30° around the spindle 2 without any rotation of the spindle. The grip ring 12 is prevented from sliding axially along the spindle 2 by means of a circlip or snap-ring 51.

Figure 11:
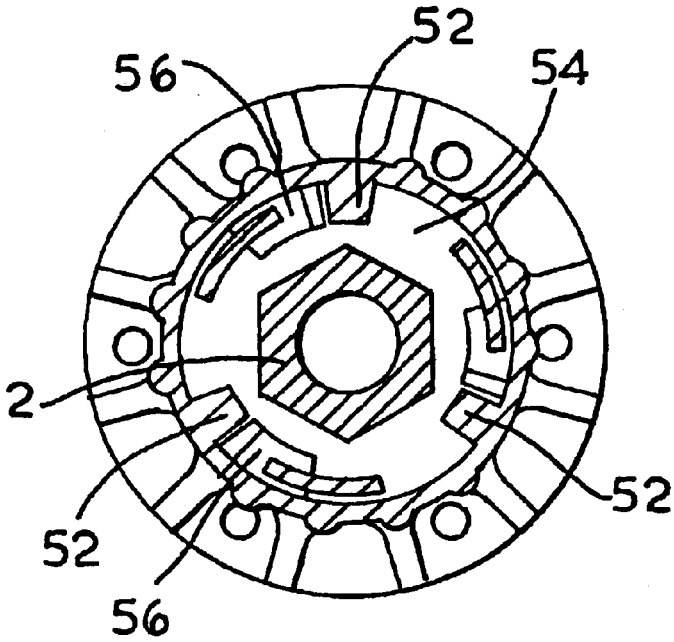
FIGS. 11 to 13 are sections through the tool holder of FIG. 8 along the lines of intersection XI—XI, XII—XII, and XIII—XIII respectively.
Figure 12:
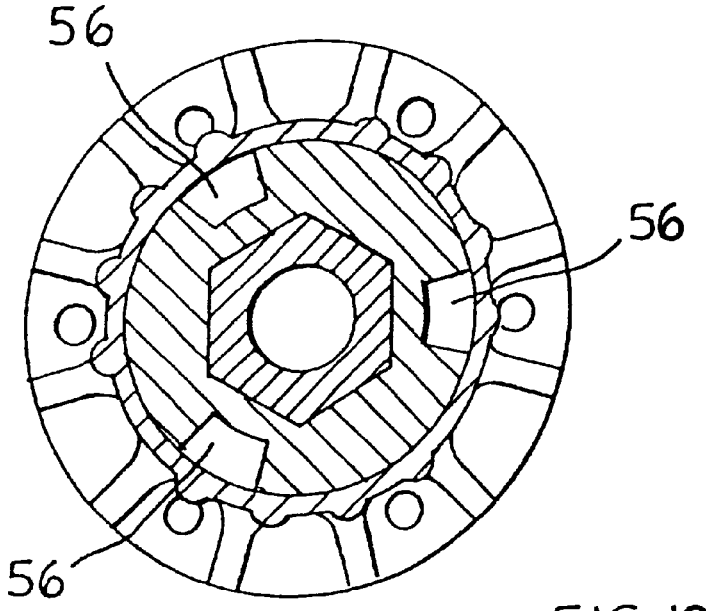
Figure 13:
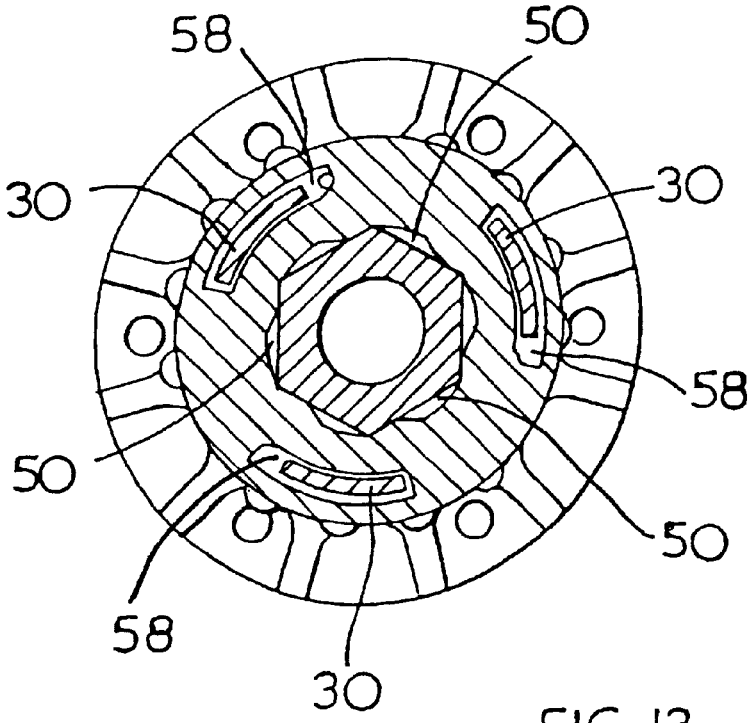
Figure 14:
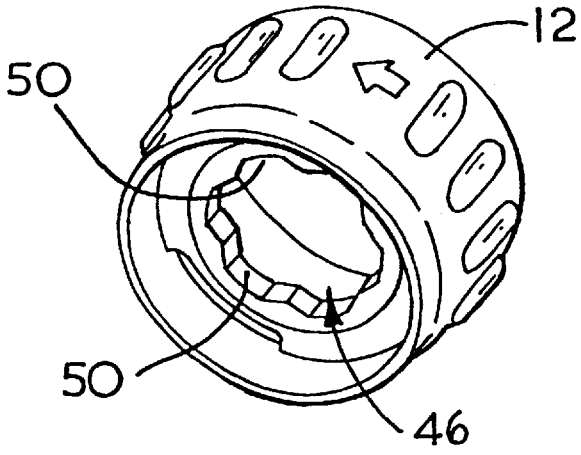
FIG. 14 is a perspective view of the grip ring of the tool holder of FIG. 8.
Figure 15:
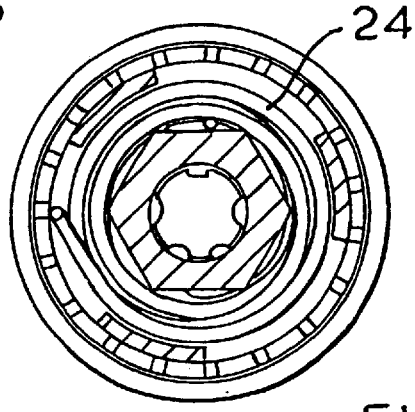
FIG. 15 is a section through the tool holder of FIGS. 8 to 14 along the line XV—XV of FIG. 10.

The grip ring 12 is provided with three axially extending fingers 52 that are located along the inner surface of the peripheral wall thereof and are arranged at 120° around the ring. As shown in FIG. 11 these fingers 52 but up against a transverse surface 54 of the locking ring 4, thereby preventing any axial movement of the locking ring 4 along the spindle 2. However, three recesses 56 are provided in the transverse surface 54 of the locking ring 4, arranged around the locking ring at 120° to one another, each recess 56 being rotationally shifted by about 30° to one of the fingers 52 when the arrangement is in its normal position as shown. Thus, rotation of the grip ring 12 by 30° (anticlockwise as viewed in FIG. 13, or in the direction of the arrow in FIG. 14) will cause the fingers 52 to be aligned with the recesses 56, and will then allow axial movement of the locking ring 4 along the spindle 2.

As in the first form of hammer, a spring 24 is provided in the grip ring 12 to bias the grip ring 12 to its normal position (as shown in the drawings), and a second helical spring 26 urges a biasing member 28 rearwardly toward the housing 1. The biasing member 28 has three legs 30 that extend through slots 58 in the interior of the grip ring 12 so that they can bear on the locking sleeve 4 under the force of the spring 26 to urge the locking ring into engagement with the housing teeth 10.

In this form of hammer, the locking ring 4 will remain engaged with the housing teeth 10 under the force of the spring 26 and biasing member 28 until the grip ring 12 is rotated by the operator. The operator can rotate the grip ring in the direction of the arrow in FIG. 14 by about 30° in order to align the fingers 52 of the grip ring with the recesses 56 in the locking ring 4. Further rotation of the grip ring 12 will cause it to apply a torque on the spindle 2 (as the opposite surfaces of the part circular or part hexagonal recesses 50 bear on the hexagonal surface of the spindle). Because the edges of the interdigitated teeth 8 and 10 are bevelled, this torque on the spindle, and hence on the locking ring 4, will cause the locking ring 4 to be urged forwardly along the axis of the spindle 2 and out of engagement with the housing, provided, of course, that the operator turns the grip ring with sufficient force to overcome the force of spring 26 acting on the bias member 28. Further rotation of the grip ring 12 by the operator will allow the tool to be set in any desired orientation in the hammer, the rotation being accompanied by ratchet-like clicking as the locking sleeve teeth 8 repeatedly engage and disengage the housing teeth 10.

Figure 16:
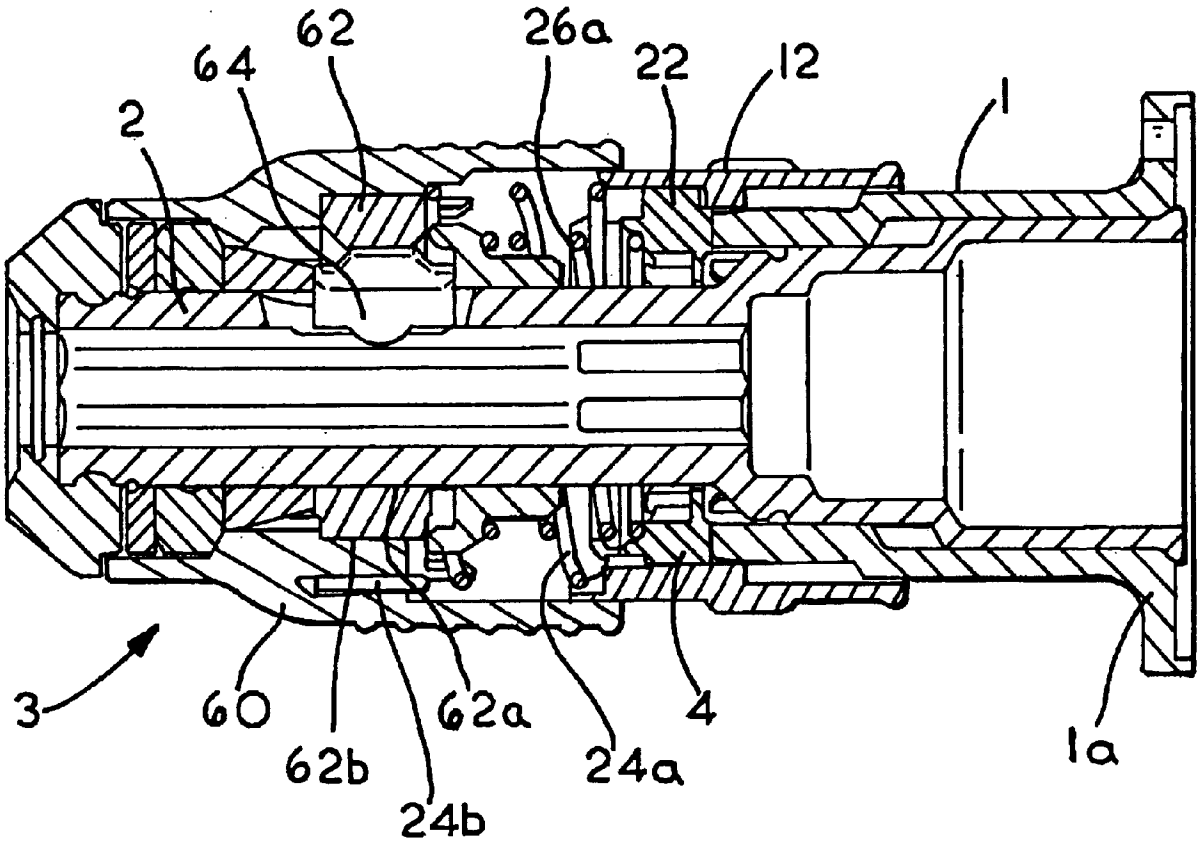
FIG. 16 is a sectional elevation of the tool holder region of a third form of hammer according to the present invention.

A further embodiment of the present invention is shown in FIG. 16. This embodiment of the adjustable spindle lock design is especially suited to tool holders for vertical demolition hammers of around the 10 kg class in which can be mounted hex shank type tools or bits. This design is similar to that described above in relation to FIGS. 1 to 7 and so like numerals are used in relation to FIG. 16 as are used in relation to FIGS. 1 to 7. The differences between the embodiment of FIG. 16 and that of FIGS. 1 to 7 are discussed below.

On the tool holder 3 of FIG. 16 is mouned a front outer sleeve portion 60 of the tool holder for facilitating the fixing of hex shank tools or bits within the tool holder. The sleeve portion 60 is non-rotatably mounted on the spindle 2. The spindle 2 has an external cross-section, which is hexagonal. A single locking element 64 locks a hex shank bit (not shown) within the hexagonally cross-sectioned spindle 2. The locking element 64 is fixed in its locked position by a locking ring 62. The locking ring 62 has an internal surface 62*a* with a cross-section which is generally hexagonal and by this means the locking ring 62 is non-rotatably mounted on the spindle 2. The outer surface of the locking ring 62*b* has an irregular cross-section over which the sleeve portion 60 is non-rotatably fitted in order to mount the sleeve portion 60 non-rotatably with respect to the spindle 2. The sleeve portion 60 is moved axially rearwardly in order to allow the locking element 64 to move radially outwardly to allow insertion or removal of a hex-shanked tool or bit.

In the embodiment shown in FIG. 16, because the sleeve portion 60 is non-rotatably fixed on the spindle 2, the coil spring 24*a* can extend between the sleeve portion 60 and the grip ring 12 to rotationally bias the grip ring 12 into its locked position. This means that the coil spring 24*a* does not have to extend from the spindle 2 (small diameter) to the grip ring 12 (large diameter) as it does in the previously described embodiments (in particular see FIGS. 7 and 15). Thus, the axial biasing member 28 which axially straddles the coil spring 24 in the previously described embodiments is no longer necessary. In the FIG. 16 embodiment the coil spring 24*a* has a uniform, relatively large, diameter along its length and the helical spring 26*a* for axially biasing the locking ring 4 extends inside the coil spring 24*a* (it has a smaller diameter) and so can bear directly on the locking ring 4, ie. the helical spring 26*a* does not bear on the locking ring 4 via an axial biasing member 28.

In the embodiment shown in FIG. 16, the coil spring 24*a* has a forward end 24*b* that is fixed in an axial recess formed in the sleeve portion 60 and has an opposite rearward end which is fixed within an axial recess (not shown) provided in the grip ring 12. In this way the coil spring 24*a* rotationally biases the grip ring 12 into its locked position. The coil spring 24*a* also acts to axially bias the sleeve portion 60 and thus the locking ring 62 into its forward locked position.

The housing 1 of the hammer comprises a metal flange 1*a* which is used to fix the tool holder arrangement shown in FIG. 16 to the remainder of the hammer housing (not shown).

The tool holder arrangement 3 in FIG. 16 can be operated as described above in relation to the embodiments of FIGS. 1 to 7 in order to adjust the orientation of a tool or bit fixed within the tool holder. If it is desired to change the orientation of the bit, the operator simply grips the grip ring 12 and rotates it until the desired orientation is reached and lets go of the ring. As the grip ring 12 is rotated, the lugs 22 on the locking ring 4 ride up the helical surface 20 of the internal shoulder of the grip ring, thereby forcing the teeth

8 and 10 out of engagement with each other against the force of the spring 26. Further rotation of the grip ring 12 causes the spindle 2 to rotate, and enables the bit inserted in the tool holder 3 to be set at the desired orientation. Release of the grip ring 12 by the operator will cause it to rotate in the opposite direction under the action of the spring 24*a*, and allow the locking ring 4 to slide axially under the action of the spring 26*a* into engagement with the teeth 10 of the housing 1. Alternatively, the sets of teeth 8 and 10 could be designed in accordance with FIG. 3*a* and the tool holder operate to change the orientation of the bit or tool as described above in relation to FIG. 3*a*.

Figure 17:
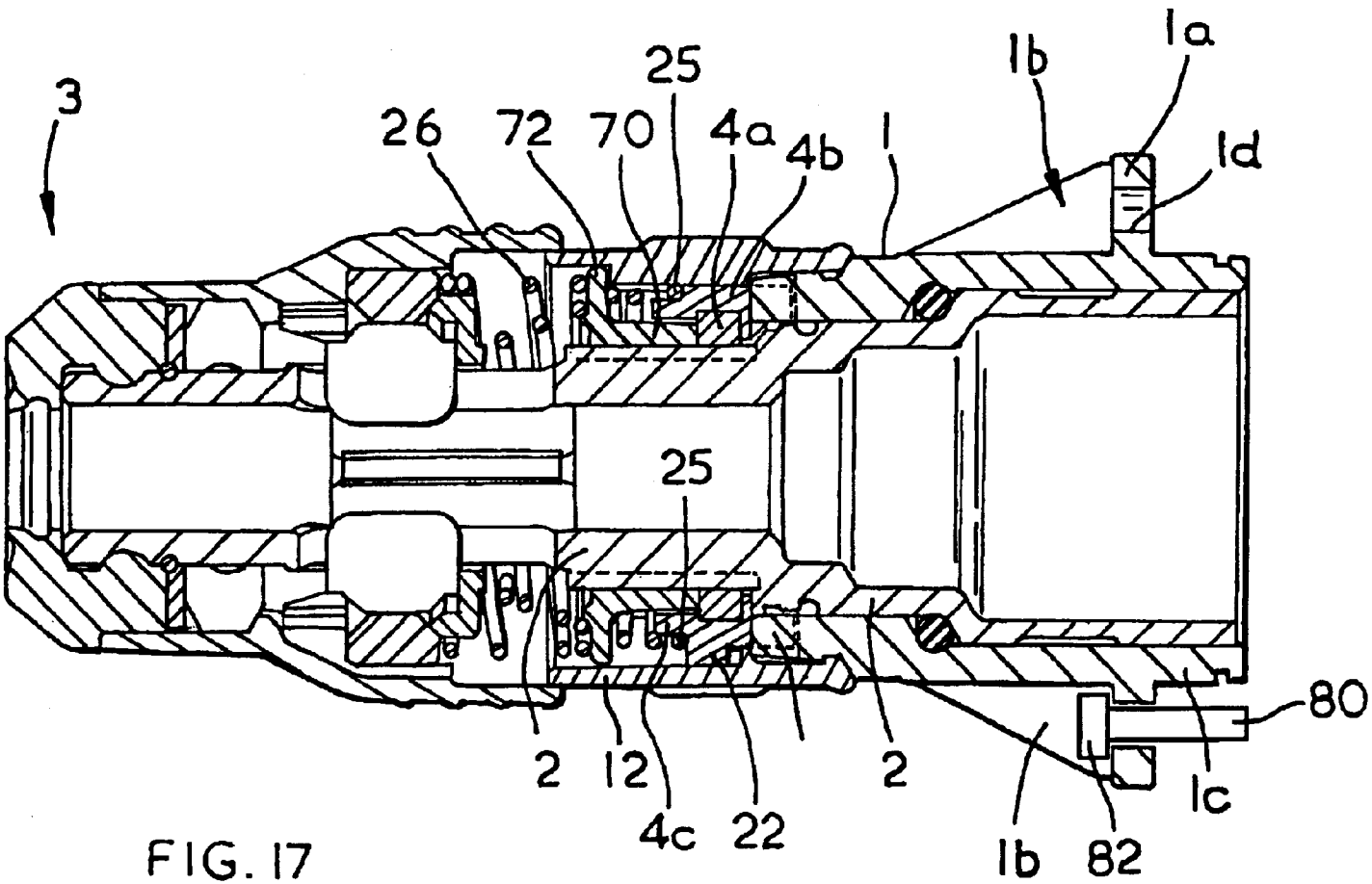
FIG. 17 is a sectional elevation of the tool holder region of a fourth form of hammer according to the present invention.
Figure 18:
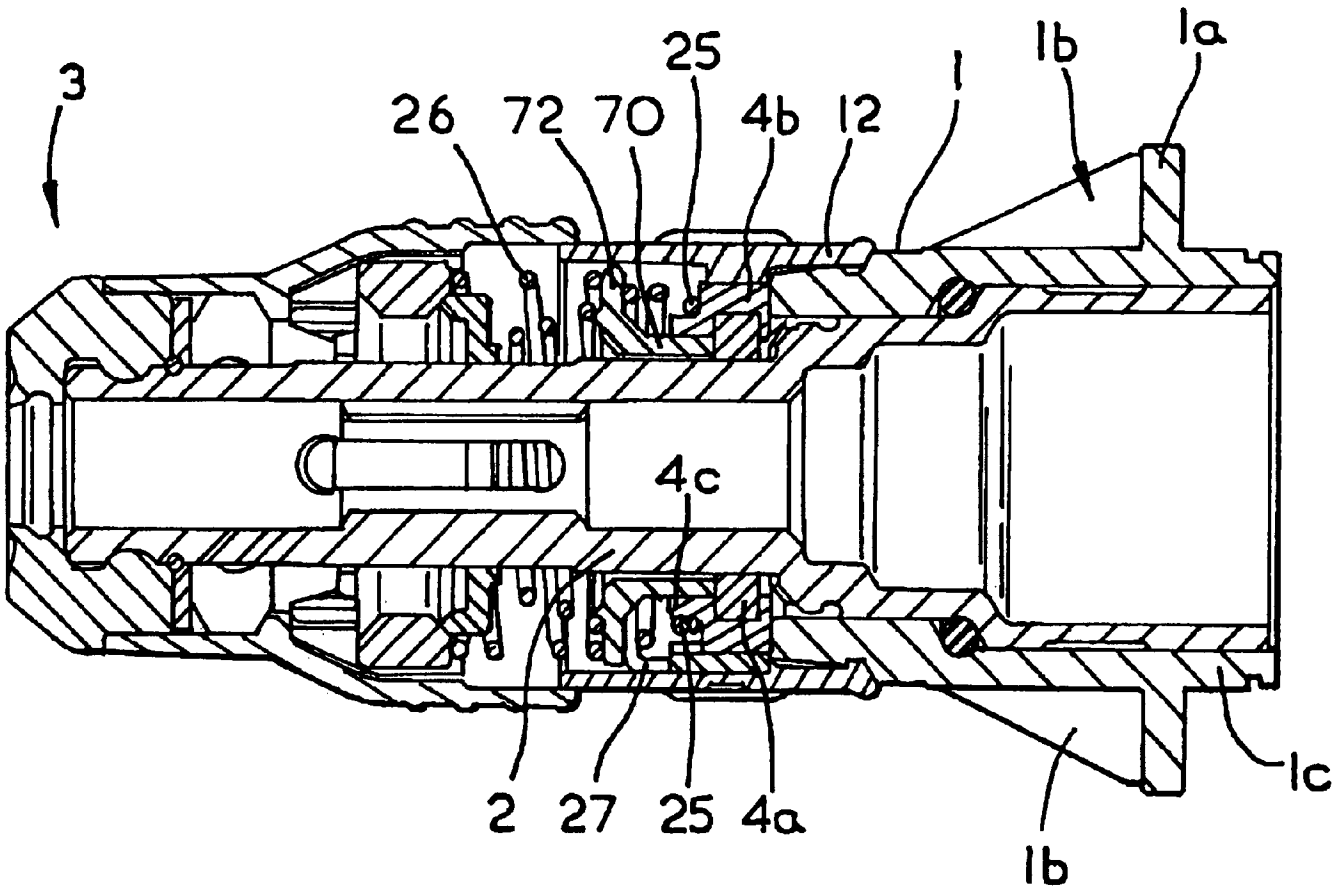
FIG. 18 is a sectional elevation of the tool holder region of the fourth form of hammer shown in FIG. 17 taken through a plane perpendicular to the plane of the sectional elevation of FIG. 17.

A further embodiment of a tool holder according to the present invention, which is particularly suited to horizontal demolition hammers in the 10 kg class which use an SDS type tool holder arrangement is shown in FIGS. 17 to 19. This design is again similar to that described above in relation to FIGS. 1 to 7 and so like numerals are used in relation to FIGS. 17 to 19 as are used in relation to FIGS. 1 to 7. The differences between the embodiment of FIGS. 17 to 19 and that of FIGS. 1 to 7 are discussed below.

Figure 19A:
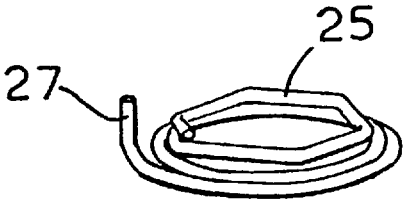
FIGS. 19*a* and 19*b* show a perspective view and a plan view respectively of the torsion spring used in the tool holder of FIGS. 17 and 18.
Figure 19B:
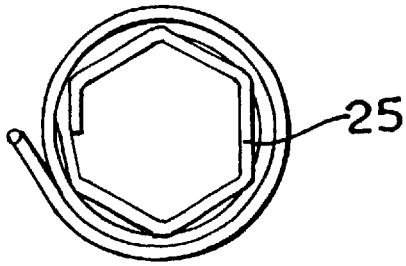

A hex spring 25 shown in FIGS. 19*a* and *b* replaces the coil spring 24 used in the designs shown in FIGS. 1 to 15 to provide rotational biasing of the grip sleeve 12 into its locked position. The hex spring 25 is different from the coil spring 24 in that it is non-rotationally fixed at its inner end to the spindle 2 due to its hexagonally shaped internal cross-section. Due to this hexagonal cross section the hex spring 25 can be non-rotatably fitted over the hexagonal outer surface of the spindle 2. This removes the requirement for a hole to be machined into the spindle 2 into which the inner end of the coil spring 24 has to be fitted during assembly in the above described embodiments of FIGS. 1 to 15 (See in particular FIGS. 7 and 15). Using a hex spring 25 as shown in FIGS. 19*a* and *b* simplifies assembly of the tool holder. The design of hex spring 25 shown in relation to FIGS. 19*a* and 19*b* can also be used to replace the torsion spring 24 and 24*a* of the embodiments shown in FIGS. 1 to 15.

In the embodiments of FIGS. 17 to 19, the axial biasing member 28 is replaced by a hexagonally cross-sectioned tube 70 with a flange 72 at its forward end. The helical spring 26 axially bears on this flange 72 and so the biasing force of the spring 26 is applied to the lock ring 4 via the tube 70. The tube 70 fits over the hexagonally shaped spindle 2 to provide a non-rotational fit. Because the three fingers 30 of the biasing member 28 are replaced by the tube 70 in the embodiment of FIGS. 17 to 19, the contact area at the interface with the lock ring 4 is increased, thus decreasing wear.

The lock ring 4 is changed from that discussed above in that it is formed from an inner metal ring 4*a* over which is moulded a plastic part 4*b* comprising the locking teeth 8, the lugs 22 and a hexagonal shaped rim 4*c* which extends around the hexagonal shaped tube part 70 discussed above. The tube part 70 bears against the metal portion 4*a* of the lock ring, providing a plastic to metal contact which is relatively wear resistant. The use of the metal ring 4*a* reinforces the plastic lock ring 4*b*. The metal ring 4*a* has radially outwardly directed teeth (not shown) around which the plastic part is moulded in order to provide a good fastening between the metal and plastic rings making up the lock ring.

The hexagonal inner part of the hex spring 25 is mounted on the outer surface of the hexagonal rim 4*c*, ie. a metal to plastic interface, instead of directly on the metal spindle 2, again providing a relatively wear resistant interface. The mounting of the inner part of the spring 25 is also at a greater diameter, because the outer diameter of the spindle 2 is less than the outer diameter of the rim 4*c* and so the rotational forces at this interface are accordingly reduced. The outer end 27 of the hex spring 25 is fitted into a recess in the grip sleeve 12 in order to rotationally bias the grip ring 12 into its locked position.

The tool holder arrangement 3 in FIGS. 17 to 19 can be operated as described above in relation to the embodiments of FIGS. 1 to 7 in order to adjust the orientation of a tool or bit fixed within the tool holder. If it is desired to change the orientation of the bit, the operator simply grips the grip ring 12 and rotates it until the desired orientation is reached and lets go of the ring. As the grip ring 12 is rotated, the lugs 22 on the locking ring 4*b* ride up the helical surface 20 of the internal shoulder of the grip ring, thereby forcing the teeth 8 and 10 out of engagement with each other against the biasing force of the tube 70. Further rotation of the grip ring 12 causes the spindle 2 to rotate, and enables the bit inserted in the tool holder 3 to be set to the desired orientation. Release of the grip ring 12 by the operator will cause it to rotate in the opposite direction under the action of the hex spring 25, and allow the locking ring 4*a*, 4*b* and 4*c* to slide axially under the action of the tube 70 into engagement with the teeth 10 of the housing 1. Alternatively, the sets of teeth 8 and 10 could be designed in accordance with FIG. 3*a* and the tool holder operate to change the orientation of the bit or tool as described in relation to FIG. 3*a*.

In the embodiments discussed in relation to FIGS. 1 to 15 and 17 to 19 a metal flange 1*a*, which is part of the hammer housing 1 is used to attach the tool holder 3 to the main housing (not shown) of the hammer. The rearward end of the flange 1*c* fits within a circular recess formed in the forward part of the main hammer housing and is fixed therein using a plurality of screws 80 which pass through a plurality of holes 1*d* in the flange 1 and are fixed within internally threaded holed within the main housing. The flange design incorporates a plurality of cooling fins 1*b* which enhance the dissipation of heat from a part of the hammer which is prone to heating up. The fins 1*b* also act to protect the screw heads 82 of the screws 80 which connect the flange to the main hammer housing. The screw heads 82 are completely contained within the space between adjacent fins 1*b* and so are protected from impact with the workpiece.

What is claimed is:

1. A hammer comprising:

a tool holder;

a housing in which the housing includes a flange, wherein the flange has a plurality of axially extending cooling fins spaced circumferentially around the flange, and the flange defines a plurality of axially extending holes circumferentially located between adjacent cooling fins, and the cooling fins have a radially outward edge; and a plurality of fasteners including a head portion and a longitudinal portion, the longitudinal portion extending axially through one of the holes and the head portion located radially inward of the radially outward edge of the adjacent cooling fins.

2. A hammer according to claim 1 and further including a spindle and wherein the flange is located radially outward of the spindle.

* * * * *